US007585228B2

(12) United States Patent
McFarlin et al.

(10) Patent No.: US 7,585,228 B2
(45) Date of Patent: Sep. 8, 2009

(54) GOLF SWING PLANE TRAINING DEVICE AND METHOD

(76) Inventors: James A. McFarlin, 1946 Barrington Ave., Los Angeles, CA (US) 90025; Margaret McFarlin, 1946 barrington Ave., Los Angeles, CA (US) 90025

( * ) Notice: Subject to any disclaimer, the term of this patent is extended or adjusted under 35 U.S.C. 154(b) by 0 days.

(21) Appl. No.: 11/833,952

(22) Filed: Aug. 3, 2007

(65) Prior Publication Data

US 2008/0032810 A1 Feb. 7, 2008

Related U.S. Application Data

(60) Provisional application No. 60/835,791, filed on Aug. 4, 2006.

(51) Int. Cl.
*A63B 69/36* (2006.01)

(52) U.S. Cl. ..... 473/258; 473/229

(58) Field of Classification Search ..... 473/219, 473/226, 229, 257, 258, 266, 269; 482/93, 482/100, 114, 119

See application file for complete search history.

(56) References Cited

U.S. PATENT DOCUMENTS

| | | | | | |
|---|---|---|---|---|---|
| 2,737,432 | A | | 3/1956 | Jenks | |
| 3,429,571 | A | | 2/1969 | Abel, Jr. | |
| 3,604,712 | A | * | 9/1971 | Prior et al. | 473/229 |
| 3,614,108 | A | | 10/1971 | Garten | |
| 3,926,430 | A | * | 12/1975 | Good, Jr. | 482/112 |
| 4,261,573 | A | * | 4/1981 | Richards | 473/229 |
| 4,449,708 | A | | 5/1984 | Humphrey | |
| 4,486,020 | A | | 12/1984 | Kane et al. | |
| 4,580,786 | A | | 4/1986 | Shipley | |
| 4,653,757 | A | | 3/1987 | Wilkinson | |
| 5,125,882 | A | | 6/1992 | LaMothe et al. | |
| 5,188,367 | A | * | 2/1993 | Gipe et al. | 473/229 |
| 5,242,344 | A | | 9/1993 | Hundley | |
| 5,301,948 | A | * | 4/1994 | Hundley | 473/229 |
| 6,855,065 | B1 | * | 2/2005 | Hamilton | 473/258 |
| 2003/0114238 | A1 | * | 6/2003 | Meneghini | 473/257 |

* cited by examiner

*Primary Examiner*—Nini Legesse
(74) *Attorney, Agent, or Firm*—Lawrence S. Cohen

(57) ABSTRACT

A golf swing plane training device is disclosed that helps the user develop a correct swing plane as well as exercise the muscle groups most effective in imparting maximum power to a golf ball. The device is portable and comprises a rotating swing plane guide, one end pivotably connected to a club shaft, for controlling the swing arc of the club shaft when swung by the user to ingrain the feel of swinging on plane. The other end of the rotating swing plane guide is connected to a rotation control assembly mounted on a vertically adjustable support frame. A resistance source is connected to the hub of the rotation control assembly.

22 Claims, 7 Drawing Sheets

GOLF SWING PLANE TRAINING DEVICE AND METHOD

RELATED APPLICATIONS

This is a utility patent application filed under 35 U.S.C. 111(a) and claiming the benefit under 35 U.S.C. 119(e)(1) of the filing date of provisional application Ser. No. 60/835,791 filed on Aug. 4, 2006

BACKGROUND OF THE INVENTION

1. Field of the Invention

The present invention relates in general to a golf swing plane training device, and more particularly to a golf swing plane training device that comprises a rotating swing plane guide, one end pivotably connected to a golf club shaft, for constraining and controlling the swing arc of the golf club shaft when swung by a golfer to ingrain the feel of swinging on plane and consequently develop a correct golf swing.

2. General Background

Golf is a sport that has a centuries-long history and has been studied exhaustively by devoted golfers in their quest to understand and master the fundamentals of the golf swing mechanics. There is a constant stream of instructions in the form of books, videos and magazine articles on various elements of the golf swing, such as grip, stance, posture, steps of the swing (backswing, downswing and follow-through) and swing plane. Likewise, there is also a steady flow of training devices being created to help golfers tackle specific aspects of the golf swing. Of all the elements, the concept of the swing plane may possibly be the most complicated to grasp.

It is generally acknowledged that one must swing "on plane" to produce a good golf shot. However, many golfers do not have a clear understanding of what the swing plane is and what it is that should be on this plane. The primary reason for this difficulty is that a golf swing is a dynamic motion in a three-dimensional space that lasts only a second or two. It is infeasible for a golfer to observe or check his/her own swing plane in real time; the viewing of one's own swing can only be done using high-speed video or sequence photograph that captures the swing in a two-dimensional space. Furthermore, other referential concepts intended to help golfers gain understanding may be misinterpreted by some. For instance, there is the "shaft plane", defined as the imaginary line that runs through the club shaft as it sits at address, and the "Hogan plane", which is an imaginary pane of glass extending from the ball to the golfer's shoulders. Conceptual planes like these serve as valuable checkpoints of a golfer's swing at discrete steps; however, they do not describe the plane the club travels on throughout a golf swing.

Put simply, a correct golf swing requires the club shaft be swung on substantially the same plane on both the backswing and the downswing. If one could observe the trail of a marker on the club shaft made during a swing, it would correspond to an elliptical arc. The arc is not circular as the golfer does not pivot around a central point through the entire swing. Hips, arms, elbows, wrists, etc. are all pivot points that are activated at different moments during the swing. Also, this elliptical arc flattens further as the swing approaches the end of the backswing, i.e., the top of the swing. Furthermore, as the downswing is initiated with a slight lower-body shift toward the target coupled with a lowering of the right shoulder and elbow (for a right-handed golfer), the elliptical arc of the downswing, if it could be observed, would be narrower than that of the backswing and likely on a slightly flatter plane. Therefore, a correct golf swing requires the downswing be on the same plane as, or a slightly flatter plane than, that of the backswing. For a normal golf shot, when the golfer is not attempting to shape the ball flight, the downswing should not be on a steeper plane than that of the backswing, which tends to lead to the dreaded "outside-in" move not conducive to a good golf shot.

Finally, there is not a singular "ideal" swing plane that is suitable for all golfers. The plane angle, which is the angle between the swing plane and the ground, varies amongst golfers depending on many factors such as height, body build, arm length proportion, spine tilt at address, etc. Additionally, for each golfer, the plane angle also varies depending on the length of the particular club being used for a golf shot and the position of the ball, i.e., the lie. As to the arc of the swing, it should be narrower on the downswing. However, the degree again differs amongst golfers depending on factors such as the amount of lower-body forward shift, ability to retain a full wrist cock on the downswing, etc. These are natural and perfectly acceptable variations; there is no singular ideal swing that all golfers should be forced to imitate.

Perhaps to a greater extent than other aspects of the golf swing, the golfer must rely on the proper feel, or muscle memory, to keep his/her swing on plane. Even with a sound understanding of the concept, it is difficult for a golfer to work on his/her swing plane without the assistance of an instructor or a training device. Many training devices have been conceived over the years to help golfers "groove" their swing and develop the desired muscle memory. These devices fall generally into three categories. One category of training devices concentrate on constant- or variable-force resistance training of the specific muscles involved in the golf swing (backswing, downswing or follow-through), and secondarily on swing plane training. Most of these devices employ a handle connected to a flexible cord which, in turn, is connected to a resistance mechanism. The resistance force discourages, but not constrains, the user from making an abrupt, jerky movement when transitioning from backswing to downswing. Also, the flexible cord exerts little control over the path of the movement of hands or the swing plane. A second category of training devices use tracks or rails to lay out a predetermined, fixed path for a real or simulated golf club. Some devices mandate the exact same plane for both the backswing and the downswing. Others construct a narrower or flatter, but fixed and non-adjustable, path for the downswing. That is to say, most of these devices do not take into account the perfectly allowable variations in golfers' swings. Also, these devices are outsized, difficult to transport, and tend to be expensive to manufacture.

A third category of training devices employ a rotating swing arm, typically a rod, which constrains and guides the motion of a real or simulated golf club. Some also include a resistance mechanism for muscle strength training. The present invention fits in this general category. Examples include: U.S. Pat. No. 2,737,432, G. M. T. Jenks; U.S. Pat. No. 3,429,571, R. Abel, Jr.; U.S. Pat. No. 3,604,712, A. P. Lansing, et at.; U.S. Pat. No. 3,614,108, E. Garten; U.S. Pat. No. 4,261,573, R. H. A. Richards; U.S. Pat. No. 4,449,708, M. N. R. Humphrey; U.S. Pat. No. 4,486,020, B. T. Kane, et al.; U.S. Pat. No. 4,580,786, B. E. Shipley; U.S. Pat. No. 4,653,757, K. E. Wilkinson; U.S. Pat. No. 5,125,882, T. A. La Mothe, et al.; and U.S. Pat. No. 5,242,344, K. W. Hundley. While these devices take a similar approach as the present invention, each has one or more of the following drawbacks. (1) The device comprises a rotating rod fixedly connected to a club shaft, restricting the club shaft to move along the same circular arc on both the backswing and the downswing. As the golf swing does not naturally follow a circular arc, the device restricts the golfer from getting full extension in the middle of the backswing and forces the golfer to lift the club or swing around his/her body toward the top of the swing. (2) The club shaft is restricted to move only on the same swing plane throughout the swing. This forces some golfers to unnecessarily alter their swing. (3) The distal end of the rod not connected to the club shaft is anchored on a vertical support; the rod freely rotates or pivots relative to the anchor. No means is provided to adjust the angle of the swing plane. (4) The rotating swing arm is a flexible tension member or a telescoping rod that does not restrict the club shaft from moving on a steeper swing plane on the downswing. (5) Dissimilar shapes are involved where the club shaft is attached to the rotating rod, creating friction and hampering smooth motion transmission. For instance, the square clubface is attached to a telescoping rod, or the tapered club shaft is fastened with a ring nut. (6) The device does not allow the user to make a full swing as the rod would not clear his/her head. (7) The device is too complicated or too expensive to manufacture to be economically viable. (8) The device is outsized or requires being anchored on an opposing wall, thus is not transportable.

There exists a need for a golf swing plane training device which comprises a rotating swing plane guide, one end pivotably connected to a golf club shaft, for constraining and controlling the swing arc which is asymmetrically elliptical, while allowing for natural variations in golfers' swings but restricting improper swing plane changes.

BRIEF SUMMARY OF THE INVENTION

The present invention relates to a golf swing plane training device that also serves as an exercising device to help the user develop the muscle memory of swinging on plane as well as exercise the muscle groups most effective in imparting maximum power to a golf ball. The device is portable and comprises a rotating swing plane guide, one end pivotably connected to a golf club shaft, for constraining and controlling the swing arc of the golf club shaft when swung by the user to ingrain the feel of swinging on plane and consequently develop a correct golf swing. The other end of the rotating swing plane guide is connected to a rotation control assembly. A resistance source is connected to the hub of the rotation control assembly to provide resistance force against the club shaft on the downswing, strengthening the muscle groups that need be activated to maximize power and intensifying the proper feel of a correct swing.

One object of the present invention provides a golf swing plane training device that is relatively compact is size and is realistically portable. The device is collapsible; it can be set up at a suitable location for a practice session, and then folded into a storage configuration.

Another object of the present invention provides a golf swing plane training device that includes a rotation control assembly mounted on a vertically adjustable support frame. The rotation control assembly is set at an angle that is adjustable, but fixed during operation. This angle determines the axis of rotation and, thus, the angle of the swing plane. The adjustability of the height of the device and the plane angle allows the device to be used by all golfers.

A further object of the present invention provides a golf swing plane training device having a swing plane guide which comprises a rotatable, largely concave swing arm to constrain and restrict the club shaft from moving down on a swing plane steeper than that of the backswing. The curved shape of the swing plane guide allows it to clear the user's head when the swing is approaching the top of the swing or the end of the follow-through. The swing plane guide further comprises a radius adjustment assembly, connected to the swing arm, which includes a linear track having an axis perpendicular to the swing plane axis of rotation. A universal pivoting assembly is employed to connect a golf club shaft to the swing arm via a carriage slidably disposed on the linear track. Thus, the golf club shaft is not connected to the swing plane guide at a fixed point, which would force the golf club shaft to follow a circular swing arc. The connecting point is at the carriage which is free to slide along the linear track, and the golf club shaft can follow a swing arc that flattens toward the top of the swing.

Still a further object of the present invention provides a golf swing plane training device that employs a universal joint for connecting the golf club shaft to the swing plane guide, allowing the club shaft to pivot freely relative to the swing plane guide and to slide within the universal joint. Hence, the swing arc is not limited to strictly follow a circular shape, and the swing arc can be extended on the backswing and narrowed on the downswing by varying degrees as is natural to different golfers. Furthermore, the radius adjustment assembly includes a swing plane varying assembly which extends and retracts axially, allowing the user to initiate the downswing on a slightly flatter swing plane.

Yet one further object of the present invention provides a golf swing plane training device that contains a resistance source for exercising the muscle groups which are most effective in transferring maximum power to a golf ball. The resistance force preferably is only engaged on the downswing and is disengaged on the backswing, as the goal during the backswing is to achieve smooth motion and full extension in order to maximize leverage.

These and other objects of the present invention will become apparent after a reading of the following description and accompanying drawings.

BRIEF DESCRIPTION OF THE SEVERAL VIEWS OF THE DRAWING

It is to be understood that like elements are identified throughout the drawings with like reference numerals.

DETAILED DESCRIPTION OF THE INVENTION

Figure 1:
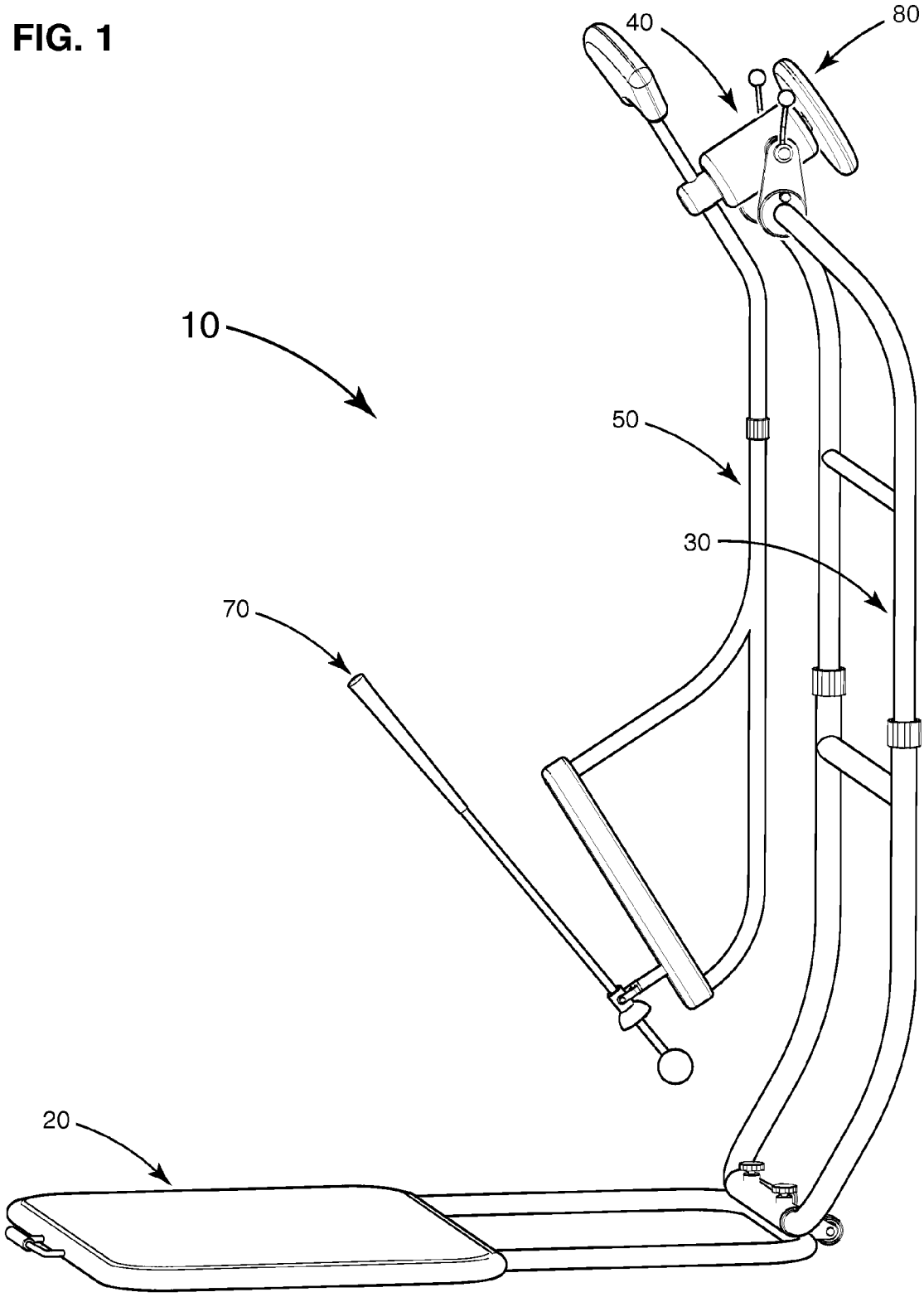
FIG. 1 is a perspective view of the preferred embodiment of the golf swing plane training device constructed in accordance with the present invention.

The golf swing plane training device according to the concepts of the present invention and how it functions can best be explained by reference to the attached drawings. As illustrated in FIG. 1, the preferred embodiment of the golf swing plane training device 10 comprises a base member 20, a support frame 30, a rotation control assembly 40, a swing plane guide 50, a simulated golf club 70, and a resistance mechanism 80.

Figure 2:
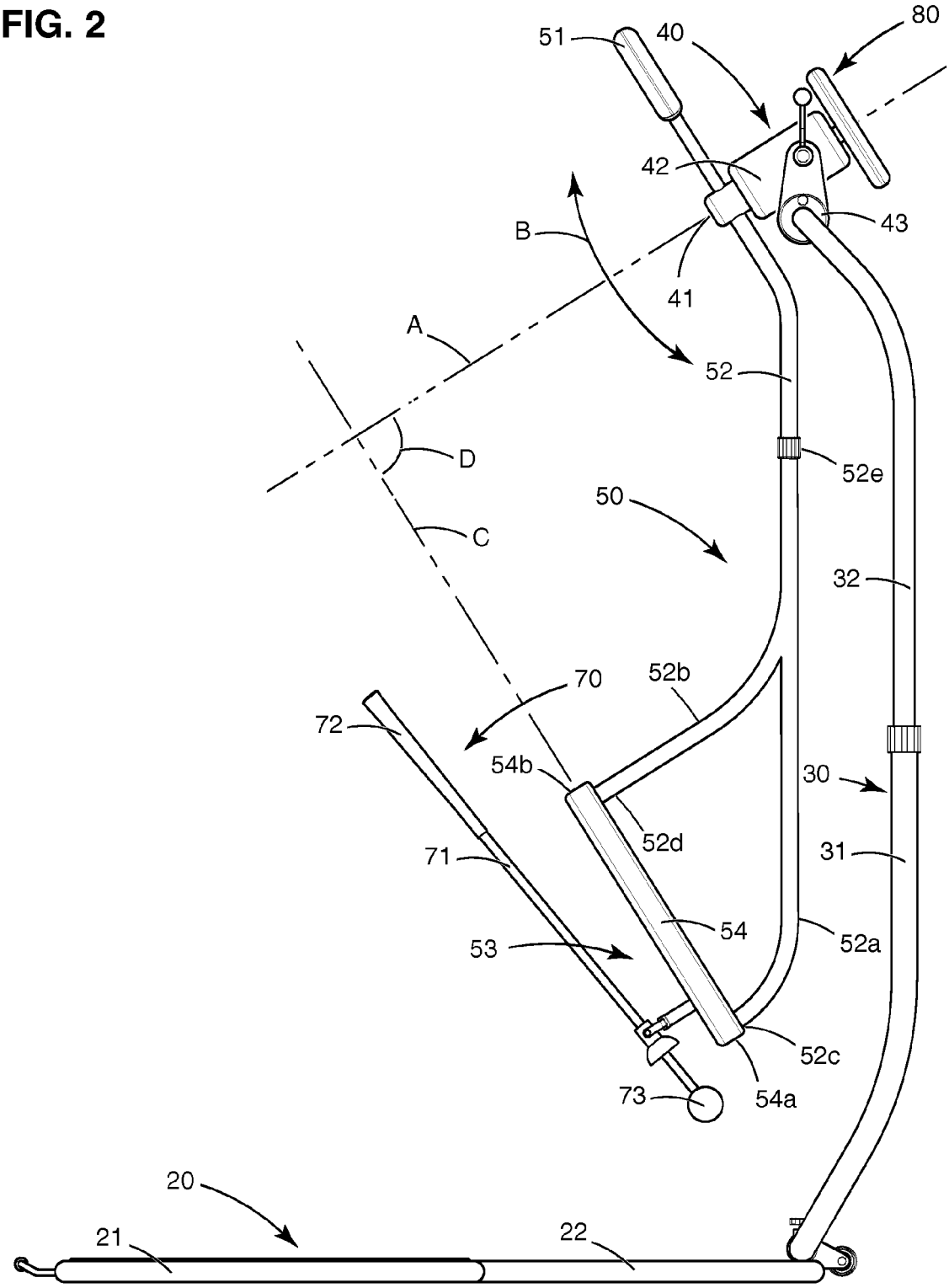
FIG. 2 is a side elevational view of the device shown in FIG. 1.
Figure 3B:
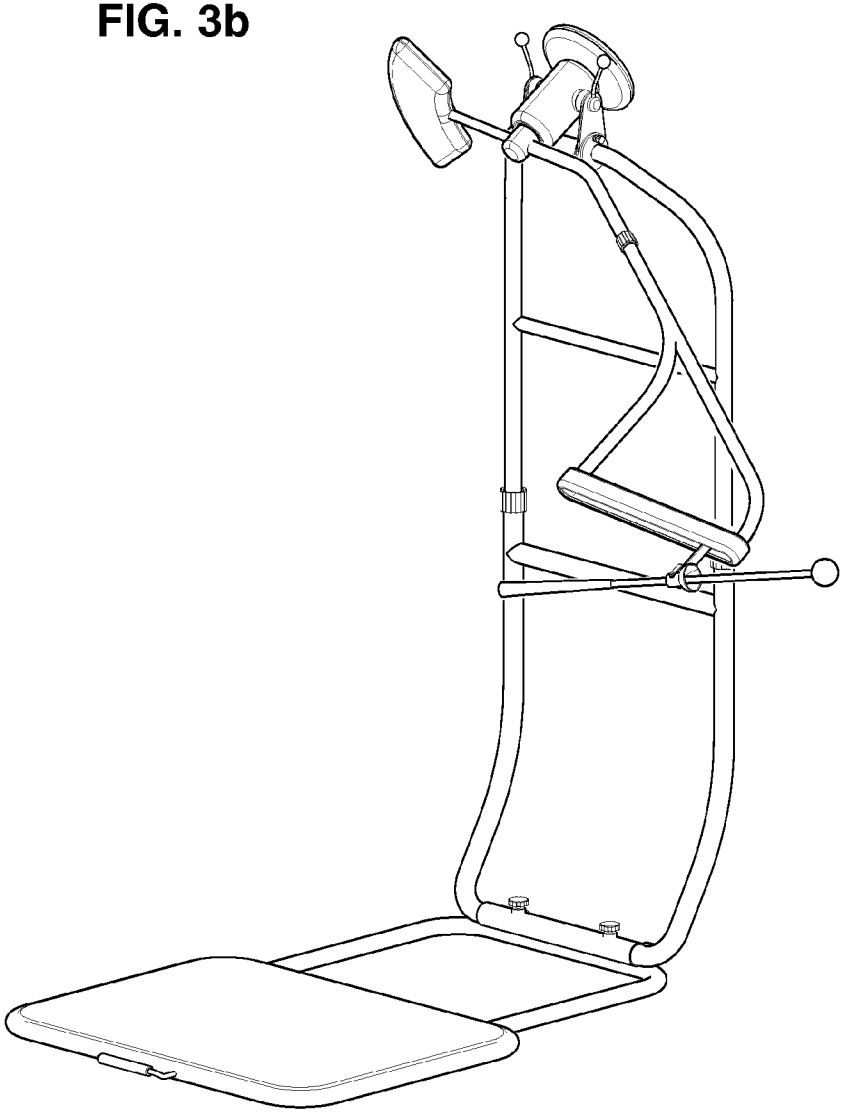
FIGS. 3*a*-3*d* are a series of perspective views of the device shown in FIG. 1 showing the device at various stages when a user (omitted from the illustration) swings the simulated golf club from the at-rest position to the top of the swing.
Figure 3A:
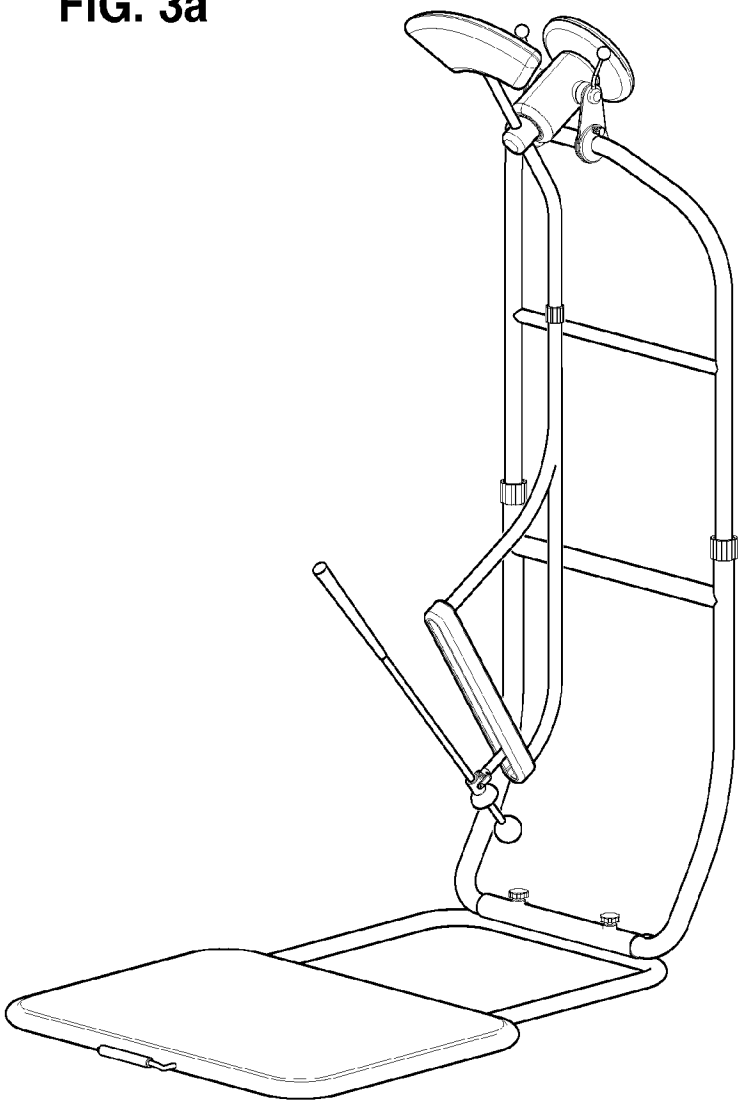
Figure 3D:
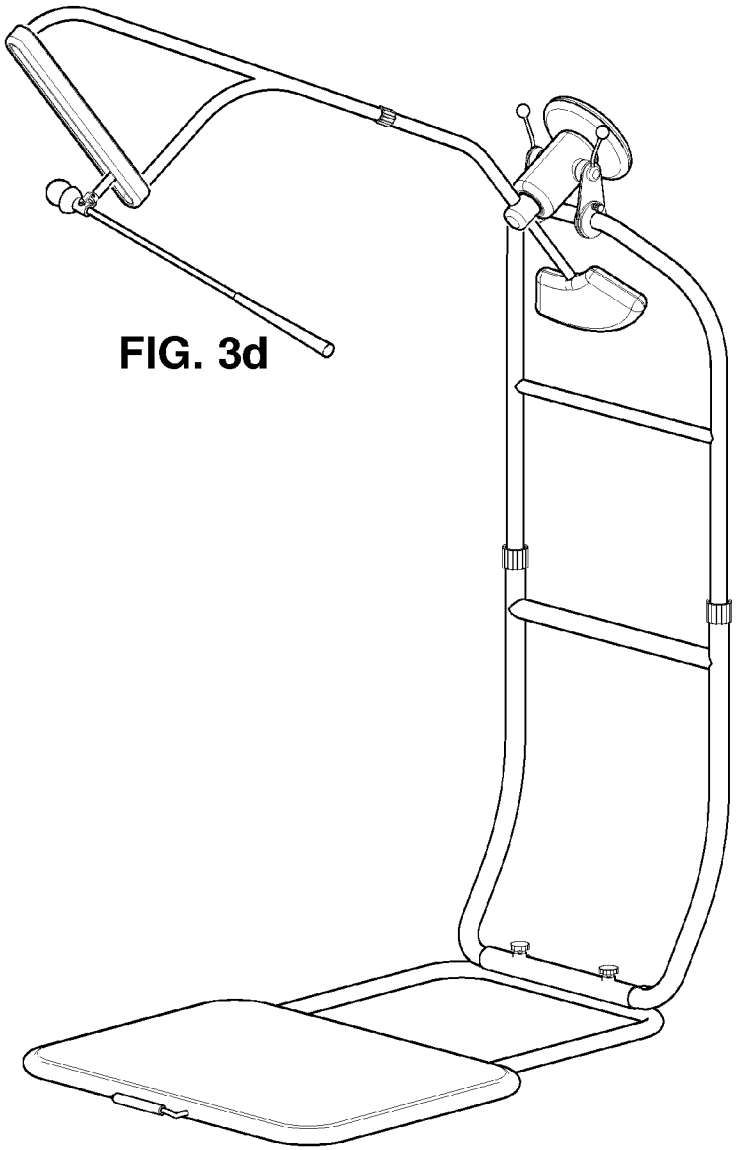
Figure 3C:
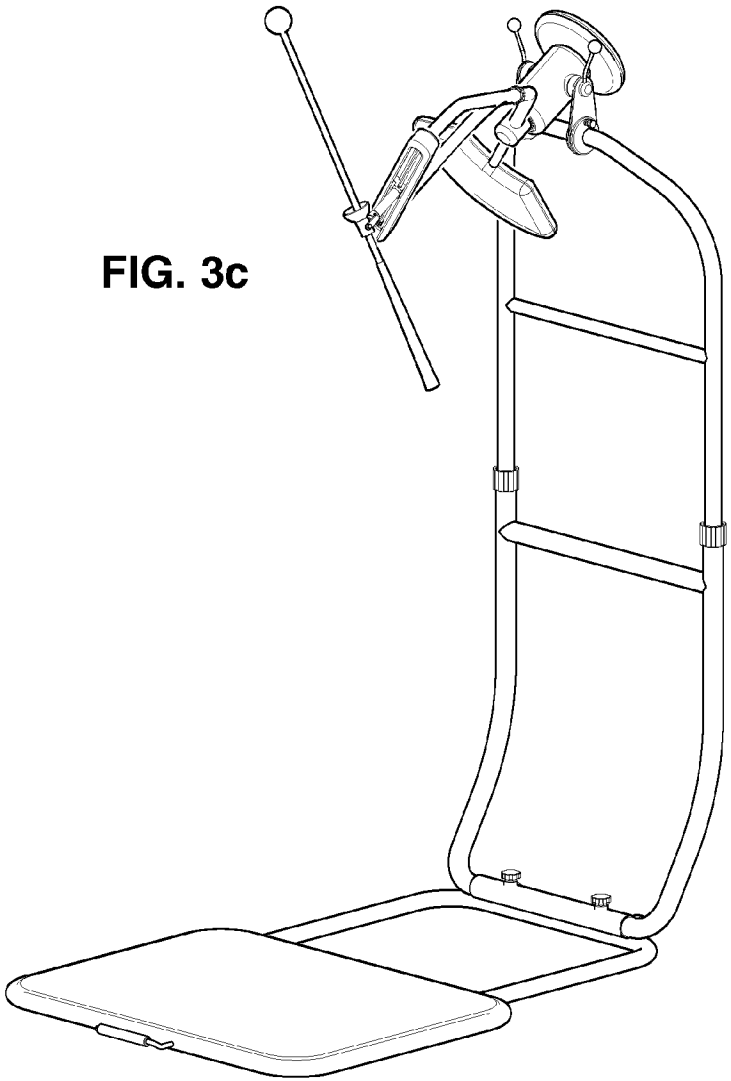

Referring now to FIG. 2, the base member 20 consists of a base platform 21 that is generally rectangular in shape for supporting and positioning the user by standing on it. The weight of the user standing on the base platform 21 serves to stabilize the device. The upright support frame 30 consists of a lower support portion 31 and an upper support portion 32. The upper support portion 32 is vertically adjustable such that the height of the device can be altered to suit the user's stature. The adjustment can be implemented using any conventional means suitable for the type of material used to fabricate the support frame 30. Suitable adjustment means include locking pins or bolts that extend through a hole in the lower or upper support portion 31 and one of a plurality of vertically spaced holes in the upper or lower support portion 32, or twist locks commonly used on tripod legs. The support frame 30 preferably is curved, approximately corresponding to the shape of the swing plane guide 50 that will be detailed later, so as to make the device more compact and portable. While curved vertical columns with cross bars are illustrated in the drawings, it will be understood that the support frame 30 can take on differing shapes without affecting its function of upholding the rotation control assembly 40, the swing plane guide 50 and the resistance mechanism 80. The support frame 30 is affixed to the base member 20 via any one of a number of securing mechanisms suitable for the material used and generally well known in the art, such as clamping knobs, fasteners or screws. The illustrations show the support frame 30 being attached to a base frame 22 extending from and welded or otherwise attached to the base platform 21. The purpose of the base frame 22 is to reduce the mass of the base member 20 to aid in the portability of the device. It is to be understood that the support frame 30 can alternatively be directly affixed to a larger-sized base platform. The support frame 30 preferably can be released from the base frame 22 and folded for storage. Additional appendages such as a handle and wheels can be added to the base member 20 to further make the device easy to transport when in the collapsed configuration.

As illustrated in FIGS. 1 and 2, the rotation control assembly 40 comprises a hub 41, which is a shaft for driving other components of the device, rotatably seated on a hub housing 42 pivotably mounted on a stand 43 affixed to the support frame 30. Preferably, the stand 43 is releasably affixed to the support frame 30 so the device can be more easily collapsed and folded into a storage configuration. Any conventional fastening means that is commonly known, such as the clamping knobs illustrated in the drawings, may be used. The hub 41 extends beyond both ends of the hub housing 42 for connecting and driving other components that will be described later. The hub 41 rotates about an axis A that defines a swing plane axis of rotation as will be described below. Preferably, at either end of the hub housing 42 around the opening through which the hub 41 extends, a ring of roller/ball bearings are employed and sandwiched between an inner race (affixed to the hub 41) and an outer race (affixed to the hub housing 42) such that the hub 41 can freely rotate with minimal rotational friction with the hub housing 42. The incline of the rotation control assembly 40 is adjustable, but fixed during operation of the device. By altering this angle as shown by angle B, the swing plane axis about which the device rotates during use is set at a desired angle of inclination, B, which also means the angle of the swing plane, being perpendicular to the axis of the hub 41, is set. Preferably, graduations or other markings are provided on the hub housing 42 so that an established inclination setting can be noted and relied upon to set up the device for subsequent use. Any conventional fastening means, such as the clamping handle with ball knobs illustrated in the drawings, that is commonly used and well known to one skilled in the art may be employed to adjustably secure the hub housing 42 to the stand 43.

Figure 4A:
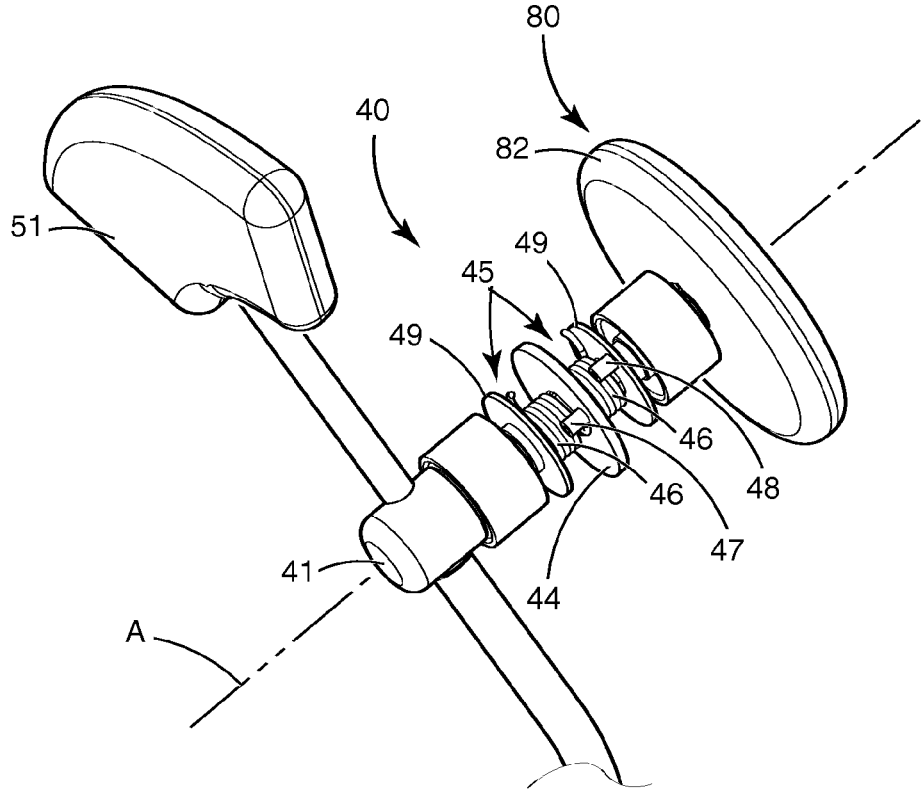
FIG. 4*a* is an enlarged front perspective view of the rotation control assembly and the resistance mechanism (and a partial portion of the swing plane guide) of the device shown in FIG. 1, with the hub housing and the stand omitted from the illustration.
Figure 4B:
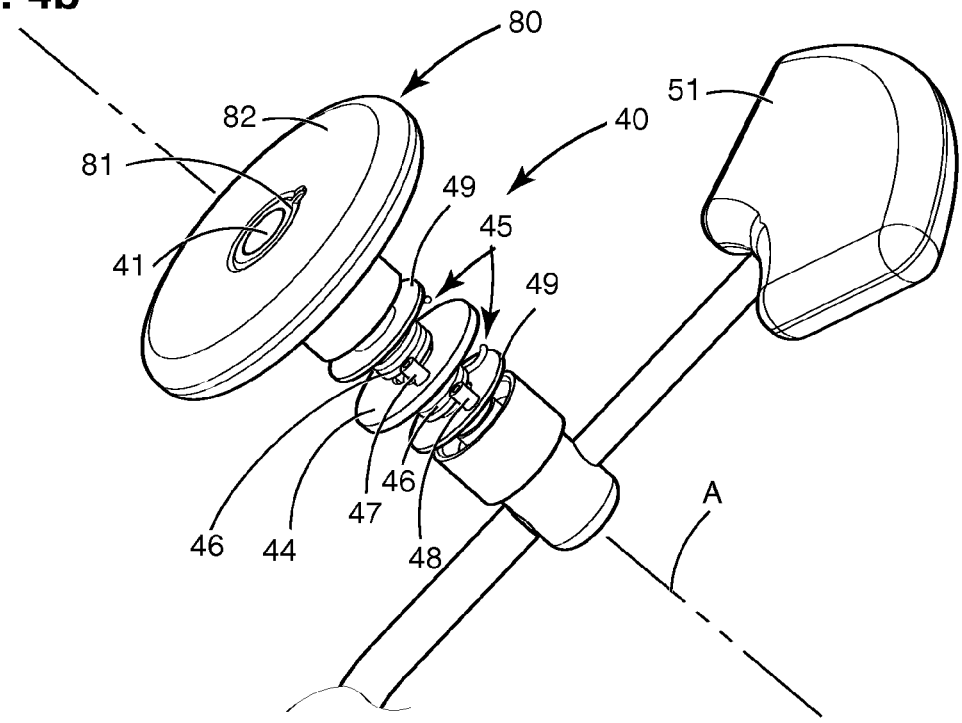
FIG. 4*b* is an enlarged rear perspective view of the rotation control assembly and the resistance mechanism (and a partial portion of the swing plane guide) of the device shown in FIG. 1, with the hub housing and the stand omitted from the illustration.

Now referring to FIGS. 4*a* and 4*b*, there is shown the rotation control assembly 40. A center brace 44 is positioned in the middle and affixed to the interior wall of the hub housing 42 (shown in FIG. 2). The hub 41 is free to rotate relative to the center brace 44. Clockwise and counterclockwise dampening means 45 are provided on either side of the center brace 44 to limit the range of rotation of the swing plane guide 50. Each dampening means 45 consists of a torsion spring 46 fitted over the hub 41, an anchor pin 47 affixed to the center brace 44, and a pickup pin 48 affixed to a disc 49 which is attached to and rotates in step with the hub 41. The placement of the pickup pin 48 relative to the anchor pin 47 is dependent on design specifications such as at what point of the swing the dampening means should be actuated and the leg angle of the torsion spring. Generally, the pickup pin 48 is positioned where it will start to engage with the leg of the torsion spring 46 when the swing plane guide 50 has rotated more than 180 degrees from its at-rest position. The counterclockwise dampening means 45 is actuated when the swing plane guide 50 has rotated counterclockwise more than 180 degrees; likewise, the clockwise dampening means 45 is actuated when the swing plane guide 50 has rotated clockwise more than 180 degrees. The pickup pin 48 engages with the leg of the torsion spring 46 only in one direction, either clockwise or counterclockwise. For instance, the pickup pin 48 of the counterclockwise dampening means 45 can only engage with the torsion spring 46 when the hub 41 is rotating counterclockwise. It simply pushes against the torsion spring 46, which rotates freely, when the hub 41 is rotating clockwise.

Referring to FIGS. 1 and 2, the swing plane guide 50 is connected by swing arm 52, preferably removably, to the front side (relative to the user) of the hub 41 for constraining and controlling the swing path of the simulated golf club 70. A counterweight 51 is provided and connected to the hub 41 opposite the swing plane guide 50 although it can be on an extension of swing arm 52. The swing arm 52 of the swing plane guide 50 is a rigid tube or rod which is largely concave relative to the user's position on the base member 20 so that it will clear the user's head when the swing is approaching the top of the backswing or the end of the follow-through. The swing arm 52 consists of upper and lower portions adjustably attached such that the radius of the swing arc can be altered to suit the user's stature. The length adjustment means 52*e* may be any conventional means suitable for the type of material used to fabricate the swing arm 52. At its lower end the swing arm 52 forks into two portions, an upper fork 52*b* and a lower fork 52*a* terminating at ends 52*d* and 52*c* respectively. The forked configuration is for the purpose of firmly connecting the radius adjustment assembly 53 to the swing arm 52.

Figure 5B:
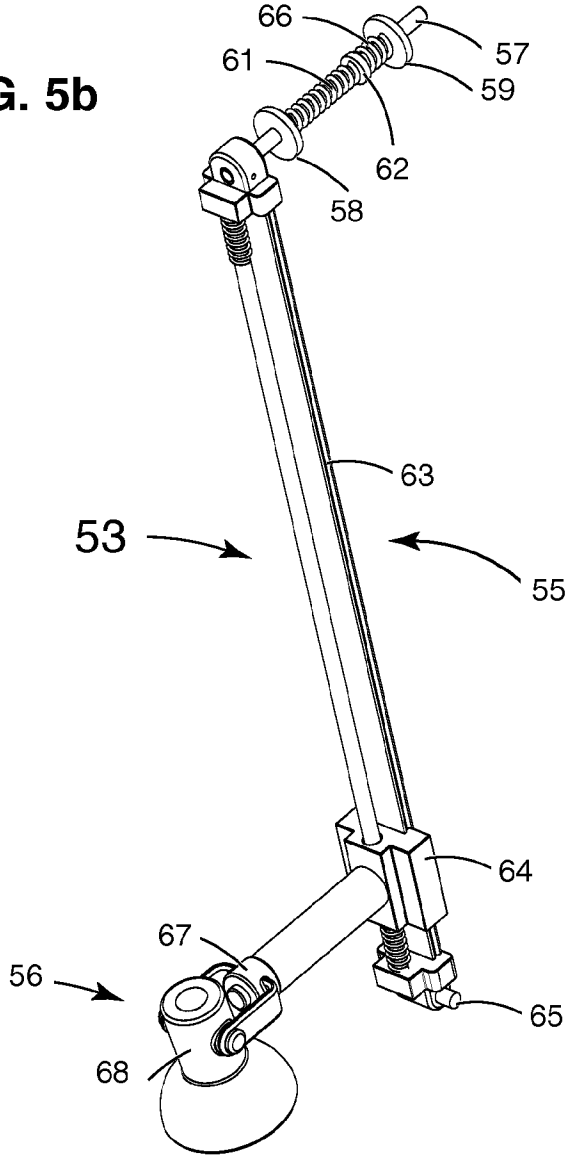
FIG. 5*b* is an enlarged perspective view of the radius adjustment assembly of the device shown in FIG. 1, with the support member omitted from the illustration.
Figure 5A:
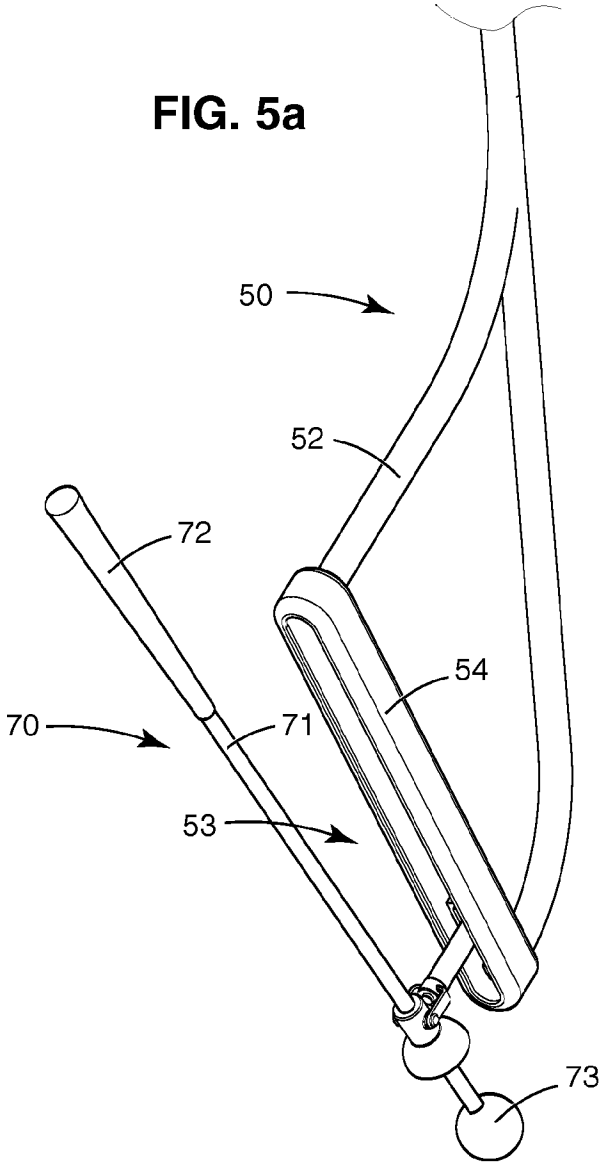
FIG. 5*a* is a partial perspective view of the swing plane guide and the simulated golf club of the device shown in FIG. 1.

Referring to FIGS. 2, 5*a* and 5*b*, the radius adjustment assembly 53 has a support member 54, a linear motion assembly 55 and a universal pivoting assembly 56. The support member 54 has a first end 54*a* and a second end 54*b* which are attached respectively to the terminating ends 52*c* and 52*d* of the lower forked portion of the swing arm 52. The support member 54 can made from a straight section of tube with the underside cut out or a section of rod or any other configuration that can be employed to attach the linear motion assembly 55 to the swing arm 52 as shown by extension line C intersecting axis A at a right angle D. The upper fork 52*b* of the swing arm 52 becomes substantially straight as it joins the radius adjustment guide 53 at 52*d*. The linear motion assembly 55 (described below) is affixed to the support member 54 for connecting the simulated golf club 70 to the swing plane guide 50 and for providing the radius adjustment during the swing. An optional part of the linear motion assembly 55, referred to as the swing plane varying assembly will be described below. The universal pivoting assembly 56 is attached to the linear motion assembly 55.

As illustrated in FIGS. 5*a* and 5*b*, the linear motion assembly 55 consists of a first part and a second part. The first part referred to as the swing plane varying assembly is contained inside or affixed to the straight portion of the upper fork 52*b* of the swing arm 52. It comprises a rod 57 slidably held in position by a front brace 58 and a back brace 59 affixed to the interior wall or the surface of the upper fork 52*b* of the swing arm 52, and a compression spring 61 fitted over the rod 57 between the front brace 58 and an actuator 62 affixed to the rod 57. The second part of the linear motion assembly 55 comprises a track 63 positioned within or otherwise mounted on the support member 54, a carriage 64 slidably disposed on the track 63. It will be understood that any linear motion guide assembly that is generally known in the industry may be employed. The end (referred to as the upper end) of the track 63 proximate the upper end 52*d* of the swing arm 52 is connected to the rod 57 and the other end (referred to as the lower end) is affixed to an end 54*a* of the support member 54 by pivot means 65 such as a pintle. The universal pivoting assembly 56 is attached to the carriage 64 for holding the simulated or training golf club 70. Hence, for a user whose downswing starts on a slightly flatter plane, when force is exerted on the track 63, it causes the rod 57 to slide generally axially compressing the compression spring 61 between the actuator 62 and the front brace 58. The center opening in the front brace 58 is slightly enlarged to accommodate the slight change in the angle between the front brace 58 and the back brace 59 during use. Preferably, an energy-absorbing element such as a spring 66 is added between the actuator 62 and the back brace 59 to absorb the return force. The universal pivoting assembly 56 is a universal joint consisting of a Y-shaped yoke 67 and a collar 68 held on a transverse bar through which the simulated or training golf club 70 is slidably fitted. The yoke 67 rotates around an axis perpendicular to the track 63 and the collar 68 rotates around an axis parallel to the track 63; consequently, the simulated golf club 70 can freely pivot relative to the linear motion assembly 55. Preferably, energy-absorbing elements such as rubber, sponge foam or springs are added at either end of the track 63 to absorb and dissipate the impact force from the carriage 64 moving back and forth along the track 63 when the device is in operation. In an alternate embodiment, if the objective is to train the user to swing on plane through the entire swing and therefore disallow the downswing to initiate on a slightly flatter plane, the first part, the swing plane varying assembly, may be omitted and the linear motion assembly 55 consists of only the second part as defined above with the track 63 fixedly attached to the swing arm 52 at both the upper and lower ends 52*d* and 52*c*.

Referring now to FIGS. 1 and 2, the simulated golf club 70 is a club shaft 71 with a handle 72 at one end and a stopper 73 removably attached to the other end to imitate a golf club. For training, a user can also use his/her own golf club or otherwise a real golf club. Therefore either the simulated or an actual golf club is referred to as a training golf club for purposes of use with the present invention. For the simulated golf club, to assemble it, the club shaft 71 is threaded through the collar 68 of the universal pivoting assembly 56 and then the stopper 73 is attached. A spring element preferably is provided and placed between the stopper 73 and the collar 68 to cushion the impact between the two parts during operation. In an alternate embodiment of the present invention, the club shaft 71 has a handle 72 at one end and the other end terminates at and is removably affixed to the collar 68 of the universal pivoting assembly 56. The simulated golf club 70 thus can still freely pivot relative the linear motion assembly 55.

In the preferred embodiment of the present invention, a resistance mechanism 80 is included to provide variable-force resistance for exercising the muscle groups which should be activated on the downswing and are most effective in transferring maximum power to a golf ball. Referring to FIGS. 1, 2, 4*a* and 4*b*, the resistance mechanism 80 comprises a freewheel 81 removably mounted on the back side of the hub 41, and a flywheel 82, which is a weighted disk, removably mounted on the freewheel 81. The attachment means for mounting the freewheel 81 on the hub 41 and the flywheel 82 on the freewheel 81 may include cooperative projections and slots, i.e., keys and keyways, or matching threads or splines. In mechanical or automotive engineering, a freewheel design typically has spring-loaded rollers inside a driven cylinder. When the driveshaft rotates in one direction, projections on the driveshaft lock with the rollers making the cylinder rotate in unison. When the driveshaft rotates slower or in the other direction, the rollers just slip and the cylinder disengages from the driveshaft. Thus, employing a freewheel design allows the resistance mechanism 80 to provide resistance in one direction only. The freewheel 81 can be flipped over for use by a left-handed golfer; differently weighted flywheels may be provided to suit golfers desiring different levels of resistance force. Alternatively, if constant-force resistance is desired for overall muscle strength training, the freewheel 81 can be replaced with a cylinder that is in continuous engagement with the hub 41 and provides constant-force resistance.

Figure 5C:
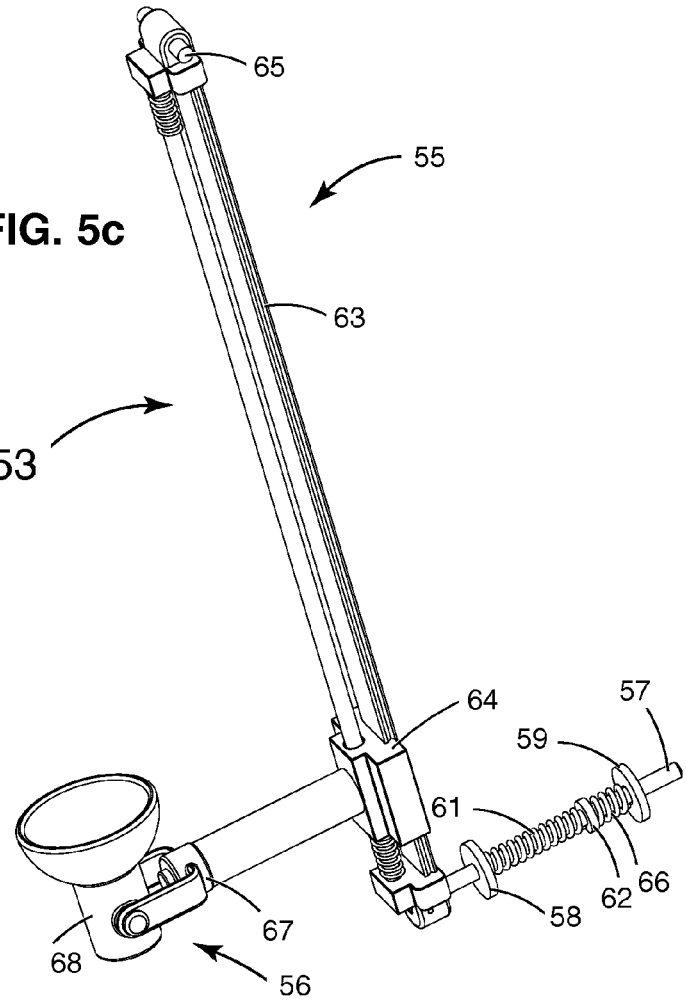
FIG. 5*c* is an enlarged perspective view of the radius adjustment assembly of the device shown in FIG. 1 oriented for the top of the backswing or the beginning of the downswing.
Figure 5D:
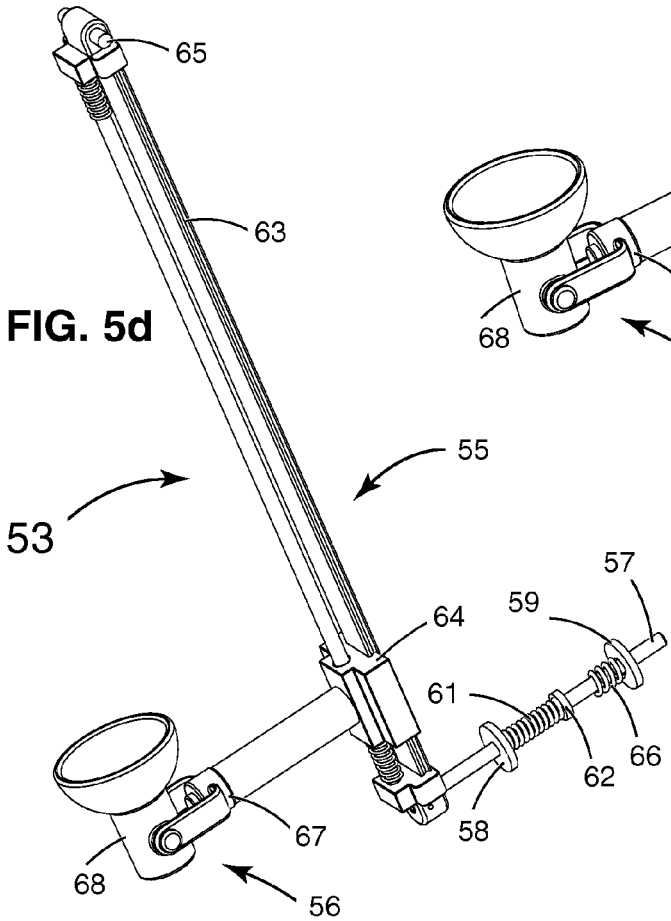
FIG. 5*d* is an enlarged perspective view of the radius adjustment assembly of the device shown in FIG. 1 oriented for the beginning of the downswing, showing the rod extending axially at the initiation of the downswing.

In use, the golf swing plane training device 10 is set up at a suitable location and the rotation control assembly 40 is adjusted to a desired angle of inclination B (FIG. 2), either from a previously noted setting or for initiating trials to identify appropriate settings for subsequent use. As the angle of the swing plane naturally changes depending on factors such as the golf club used and the lie, it is advisable for the user to practice with different settings so as to "groove" his/her swing with the swing plane at different angles. Depending on the goal of the practice session, the resistance mechanism 80 may be mounted with a flywheel 82 of the desired weight, or omitted entirely. Referring to FIGS. 3*a*-3*d*, which show the backswing, as the user takes the simulated golf club 70 back, the swing plane guide 50 constrains the club shaft 71 to stay on the swing plane, but allows it to extend through the collar 68 to follow an elliptical arc. As the simulated golf club 70 approaches the top of the swing, the swing arc flattens further. The radius adjustment assembly 55 allows the club shaft 71, connected to the carriage 64 via the universal pivoting assembly 56 to slide lower along the track 63 while still staying on plane. If the user makes a full swing, the counterclockwise dampening means 45 (for a right-handed user) is actuated to dampen the momentum and slow down the simulated golf club 70 to prevent it from going much past horizontal. Now referring to FIGS. 5*c* and 5*d* (oriented in the drawings for the top of the backswing or the beginning of the downswing), if the user's downswing naturally follows a slightly flatter swing plane, the initiation of the downswing pulls on the track 63 which, in turn, causes the rod 57 to extend axially and the actuator 62 to compress the compression spring 61 against the front brace 58. As the compressive force abates during the downswing and the compression spring 61 returns to its original form, in the middle of the downswing, the rod 57 retracts and the simulated golf club 70 is guided back to the original swing plane before it reaches the impact zone. Therefore, the swing plane guide 50 constrains the club shaft 71 to move on the same or a slightly flatter plane on the downswing, but restricts the club shaft 71 from moving down on a steeper plane, i.e., the "outside-in" or "over-the-top" move that many recreational golfers make. The clockwise dampening means 45 is actuated to slow down the club as the swing reaches the end of the follow-through.

To conclude, with respect to the above description, it is to be understood that the optimal dimensional specifications for the parts of the invention, including variations in number, size, shape, form, placement, material and the method of fabrication and assembly, are deemed readily apparent to persons skilled in the art upon a reading of the foregoing description, and all equivalent specifications to those illustrated in the drawings and detailed in the description are intended to be encompassed by the present invention.

Further, it will be obvious to those skilled in the art that various modifications and revisions can be made to the embodiment shown herein without departing from the spirit and essential characteristics of the invention. It is therefore intended by the appended claims to cover any and all such modifications and revisions within the scope of the present invention.

What is claimed is:

1. A golf swing plane training device for developing a correct swing plane by constraining and controlling the swing arc of a golf club shaft when swung by the user, the device comprising:

an upright support frame;

a rotation control assembly mounted proximate the top of the upright support frame and having a rotatable hub defining a swing plane axis of rotation during the swing and being pivotably mounted for pivoting of the swing plane axis of rotation a plane of inclination which is selected and fixed before the swing;

a swing plane guide having a swing arm connected proximate one end to and rotatable with the hub about the swing plane axis of rotation, and having a radius adjustment assembly affixed to a distal end of the swing arm;

the radius adjustment assembly comprising a linear motion assembly and a universal pivoting assembly connected to the linear motion assembly;

the linear motion assembly defining a linear slide axis at an angle perpendicular to the swing plane axis of rotation and having a slide member slidable along the linear slide axis thereby allowing radial sliding during the swing, the universal pivoting assembly being connected to the slide member for sliding along the linear slide axis during the swing and having an attachment element for slidable attachment to the shaft of a training or simulated golf club and for universal pivoting with respect to the slide member for sliding along the shaft during the swing;

whereby when a user swings a training or simulated golf club it is constrained and controlled to travel in a swing pattern defined and allowed by the swing arm and the radius adjustment assembly.

2. The golf swing plane training device of claim 1 further comprising a simulated or training golf club having a shaft portion slidably fittable to the attachment element.

3. The golf swing plane training device of claim 1 further comprising a swing plane varying assembly that will allow the linear motion assembly to pivot angularly out of the perpendicular angle to the swing plane axis of rotation (the normal position) upon a sufficient lateral force being placed upon it by the swing of the club, the swing plane varying assembly being located at and attached to an upper end of the linear motion assembly and wherein a lower end of the linear motion assembly is pivotably mounted on a support member which is affixed to the distal end of the swing arm, the swing plane varying assembly comprising a spring loaded control assembly for allowing the pivoting and acquiring restoring force upon the lateral force causing pivoting of the linear motion assembly from its normal position and for restoring the linear motion assembly to its normal position as the lateral force is abated during a swing.

4. The golf swing plane training device of claim 3 wherein said swing plane varying assembly comprises a rod extending laterally from the upper end of the linear motion assembly, a compression spring placed over the rod and having a far end fixed to the rod and a near end fixed directly or indirectly with relationship to the swing arm, whereby said lateral force will cause the upper end of the linear motion assembly to pivot away from the swing arm thereby compressing the spring to control the amount of the pivoting and to provide the restoring force.

5. The golf swing plane training device of claim 4 wherein said swing plane varying assembly further comprises the rod extending through a front brace fixed in relationship to the swing arm and the compression spring is fitted on the rod, and an actuator is fixed on the rod at a selected distance from the front brace, and the compression spring is mounted on the rod between the front brace and the actuator whereby the lateral motion will cause the rod and the actuator to move toward the front brace thereby compressing the spring.

6. The golf swing plane training device of claim 1 wherein the radius adjustment assembly further comprises a support member affixed to the distal end of the swing arm and the linear motion assembly is affixed to the support member.

7. The golf swing plane training device of claim 6 wherein the swing plane arm distal end is forked to provide an upper fork member and a lower fork member and the support member is affixed at respective ends to the upper and lower fork members.

8. The golf swing plane training device of claim 1 wherein the rotation control assembly further comprises a dampening apparatus adapted to impose a resistance to rotation of the hub in both clockwise and counterclockwise rotation directions.

9. The golf swing plane training device according to claim 8 wherein the hub is rotatably mounted in a hub housing which is pivotably adjustable for pivoting the swing plane axis of rotation in a plane of inclination and wherein each dampening means comprises a torsion spring fitted over the hub, an anchor pin affixed to a center brace affixed to the hub housing, and a pickup pin affixed to a disc attached to and rotates in step with the hub, whereby the pickup pin staffs to engage with the leg of the torsion spring when the swing plane guide has rotated a selected number of degrees from its at-rest position wherein the pickup pin engages with the leg of the torsion spring only in one direction, either clockwise or counterclockwise.

10. The golf swing plane training device of claim 8 wherein the dampening apparatus comprises a first torsion spring around the hub having one end fixed to the hub and its other end positioned for contact with a pickup pin fixed with relationship to the hub for tightening when the hub rotates counterclockwise.

11. The golf swing plane training device of claim 10 wherein the dampening apparatus further comprises a second torsion spring around the hub and having one end fixed to the hub and its other end positioned for contact with a pickup pin fixed in relationship to the hub for tightening when the hub rotates clockwise.

12. The golf swing plane training device of claim 1 wherein the rotation control assembly is mounted for adjustably selected pivoting of the hub to adjust setting of the swing plane axis of rotation of the hub in a plane of inclination.

13. The swing plane training device of claim 1 wherein the rotation control assembly further comprises a resistance mechanism for exercising the muscle groups used in a golf swing.

14. The golf swing plane training device of claim 13 wherein the resistance mechanism comprises a direction reversible freewheel on the hub and a weight member attached to the freewheel.

15. The golf swing plane training device of claim 14 wherein the freewheel is removably mountable and the direction is made reversible by turning the freewheel over.

16. The golf swing plane training device according to claim 13 wherein the resistance mechanism comprises a freewheel removably mounted on the hub, and a weighted disk removably mounted on the freewheel, whereby the resistance mechanism engages on the downswing and provides resistance in one direction only.

17. The golf swing plane training device of claim 1 further comprising a base platform attached to the upright support frame at a lower end thereof.

18. The golf swing plane training device of claim 1 wherein the hub is rotatably mounted in a hub housing which is pivotably adjustable for pivoting the swing plane axis of rotation in a plane of inclination.

19. The golf swing plane training device of claim 18 wherein the hub housing is affixed to pivot adjusting frame mounted on the upright support frame and the pivot adjusting frame has means to selectably change the plane of inclination.

20. The golf swing plane training device of claim 1 wherein the universal pivot assembly is a universal joint that comprises a Y-shaped yoke and a collar held on a transverse bar through which the simulated golf club is slidably fitted whereby the yoke rotates around an axis perpendicular to the linear slide axis and the collar rotates around an axis parallel to the linear slide axis.

21. The golf swing plane training device of claim 20 wherein the simulated or training golf club comprises a club shaft that slidably passes through collar of the universal joint, a handle at one end, and a stopper removably attached to the other end.

22. The golf swing plane training device of claim 1 further including a counterbalance connected to the hub opposite the swing plane guide.

* * * * *